US008254826B2

(12) United States Patent
Uchino et al.

(10) Patent No.: US 8,254,826 B2
(45) Date of Patent: Aug. 28, 2012

(54) IMAGE RECORDING DEVICE INCLUDING MOVING MECHANISM FOR FEED UNIT ROTATING MEMBER

(75) Inventors: Yuta Uchino, Nagoya (JP); Takashi Ohama, Iwakura (JP); Naokazu Tanahashi, Nagoya (JP); Wataru Sugiyama, Aichi-ken (JP); Noriyuki Kawamata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 970 days.

(21) Appl. No.: 12/179,285

(22) Filed: Jul. 24, 2008

(65) Prior Publication Data

US 2009/0026685 A1 Jan. 29, 2009

(30) Foreign Application Priority Data

Jul. 24, 2007 (JP) ..... 2007-191616

(51) Int. Cl.

| | |
|---|---|
| ***G03G 15/00*** | (2006.01) |
| ***B41J 3/60*** | (2006.01) |
| ***B41J 3/62*** | (2006.01) |
| ***B41J 17/00*** | (2006.01) |
| ***B65H 29/00*** | (2006.01) |
| ***B65H 39/10*** | (2006.01) |

(52) U.S. Cl. ..... 399/401; 400/188; 271/186; 271/291

(58) Field of Classification Search ..... 399/401; 400/188; 271/291, 186, 3.14, 65

See application file for complete search history.

(56) References Cited

U.S. PATENT DOCUMENTS

| | | | | |
|---|---|---|---|---|
| 2007/0081199 | A1* | 4/2007 | Koga et al. | 358/450 |
| 2007/0122225 | A1* | 5/2007 | Izuchi et al. | 400/624 |

FOREIGN PATENT DOCUMENTS

| | | | |
|---|---|---|---|
| JP | H10-120218 | A | 5/1998 |
| JP | 11209008 | A | 8/1999 |
| JP | 2003-226053 | A | 8/2003 |
| JP | 2005345766 | A | 12/2005 |
| JP | 2006-151674 | A | 6/2006 |
| JP | 2006-176260 | A | 7/2006 |
| JP | 2007145574 | A | 6/2007 |

OTHER PUBLICATIONS

Japan Patent Office, Decision of Patent Grant for Japanese Patent Application No. 2007-191616, dispatched Nov. 1, 2011.

* cited by examiner

*Primary Examiner* — Judy Nguyen
*Assistant Examiner* — Blake A Tankersley
(74) *Attorney, Agent, or Firm* — Baker Botts L.L.P.

(57) ABSTRACT

An image recording device includes: a tray having a placing surface; a feed unit comprising a rotating member configured to move in a first direction away from the placing surface of the tray and move in a second direction toward the placing surface of the tray; a frictional member disposed on the placing surface; a recording unit; a conveying unit configured to return the sheet, on one side of which the image has been recorded by the recording unit, to the placing surface; and a moving mechanism configured to move the rotating member in the first direction and in the second direction. The moving mechanism is configured to move the rotating member in the first direction before a leading end of the sheet returned by the conveying unit reaches the frictional member in a state where no sheet is placed on the tray.

11 Claims, 11 Drawing Sheets

IMAGE RECORDING DEVICE INCLUDING MOVING MECHANISM FOR FEED UNIT ROTATING MEMBER

CROSS-REFERENCE TO RELATED APPLICATIONS

This application is based upon and claims the benefit of priority from Japanese Patent Application No. 2007-191616, filed on Jul. 24, 2007, the entire contents of which are incorporated herein by reference.

TECHNICAL FIELD

The present invention relates to an image recording device configured to record an image on a sheet conveyed along a predetermined conveying path.

BACKGROUND

Image recording devices having a double-side recording function (double-side printing function) are known. For example, a sheet is conveyed from a sheet feeding tray to a recording unit by a feed roller and an image is recorded on one side of the sheet. The sheet on one side of which an image has been recorded (hereinafter, referred to as a "one-side recorded sheet") is conveyed in a switch-back manner at a downstream side of the recording unit, is returned to the upstream side of the recording unit, and is conveyed to the recording unit again. Then, an image is recorded on the other side by the recording unit.

As an example of such an image recording device, JP-A-2007-145574 discloses that a one-side recorded sheet is returned to the upstream side via a sheet feeding tray.

A frictional member is disposed on a top surface of the sheet feeding tray. The frictional member is provided to prevent so-called overlap conveyance in which several sheets are overlapped and conveyed when the number of sheets stacked in the sheet feeding tray. However, in the image recording device described in JP-A-2007-145574, when a double-side recording operation is performed on the final sheet remaining in the sheet feeding tray, the one-side recorded sheet may not enter a contact portion between the frictional member and a feed roller brought into contact with the frictional member because of the frictional force of the frictional member at the time of returning the one-side recorded sheet to the sheet feeding tray. In this case, the one-side recorded sheet may not be conveyed to the upstream and the surfaces of the frictional member, and the feed roller may be abraded due to the idling of the feed roller.

SUMMARY

An object of one aspect of the invention is to provide an image recording device that can reliably convey a sheet.

According to an aspect of the invention, there is provided an image recording device comprising: a tray having a placing surface on which a sheet is allowed to be placed; a feed unit comprising a rotating member that is rotatable and configured to move in a first direction away from the placing surface of the tray and move in a second direction toward the placing surface of the tray; a frictional member disposed on the placing surface and located at a position corresponding to the rotating member; a recording unit configured to record an image on the sheet conveyed from the tray by the rotating member; a conveying unit configured to return the sheet, on one side of which the image has been recorded by the recording unit, to the placing surface of the tray from a downstream side of the recording unit; and a moving mechanism configured to move the rotating member in the first direction and in the second direction, wherein the moving mechanism is configured to move the rotating member in the first direction before a leading end of the sheet returned by the conveying unit reaches the frictional member in a state where no sheet is placed on the tray.

DESCRIPTION

Hereinafter, embodiments of the invention will be described with reference to the accompanying drawings. The embodiments to be described below are only examples of the invention and the embodiments can be properly modified without departing from the scope of the invention.

First Embodiment

Figure 1:
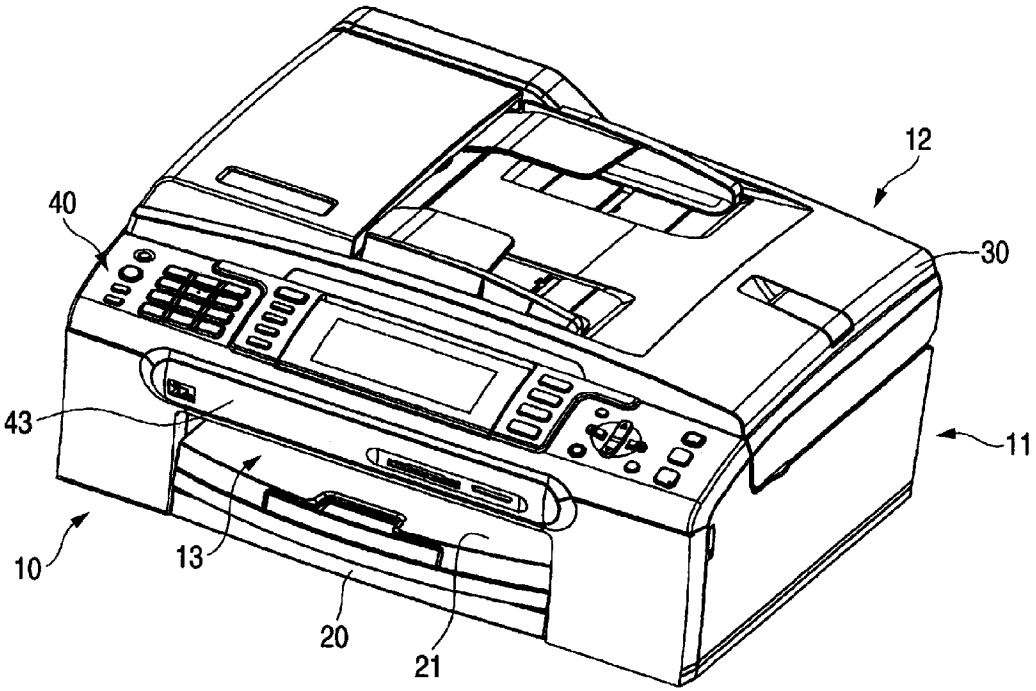
FIG. 1 is a perspective view illustrating an appearance of a multi function device according to a first embodiment of the invention.
Figure 2:
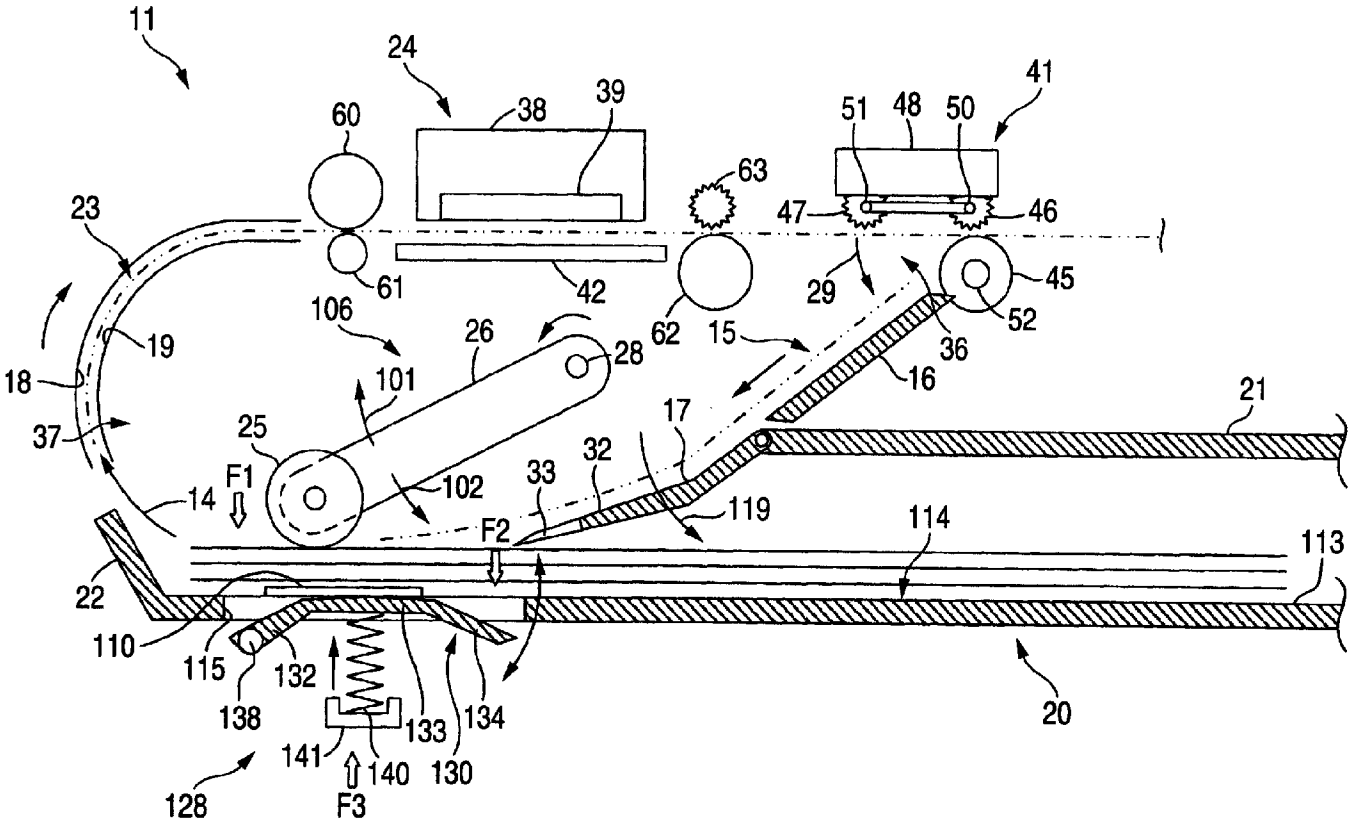
FIG. 2 is a sectional view schematically illustrating a structure of a printer unit.
Figure 3:
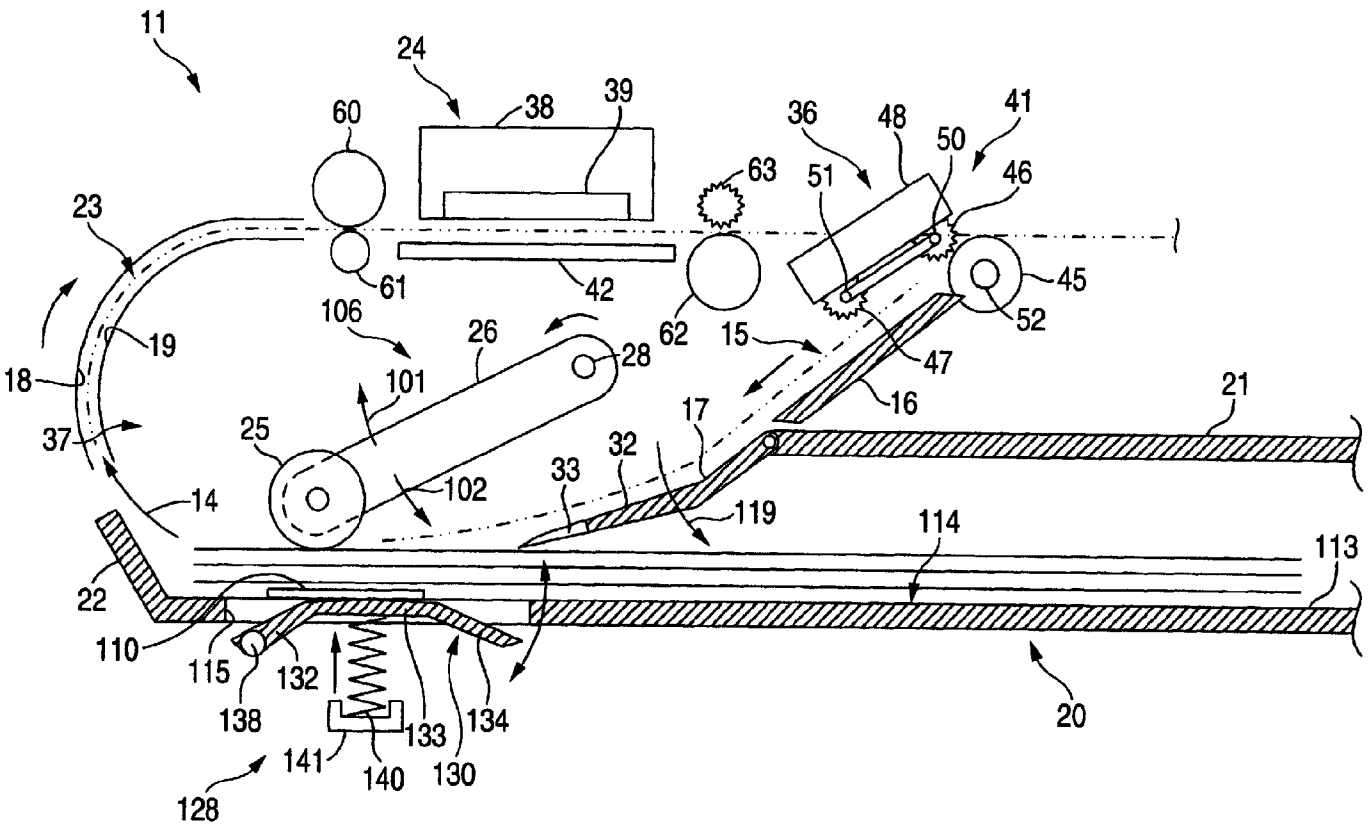
FIG. 3 is a sectional view schematically illustrating a structure of the printer unit.
Figure 4:
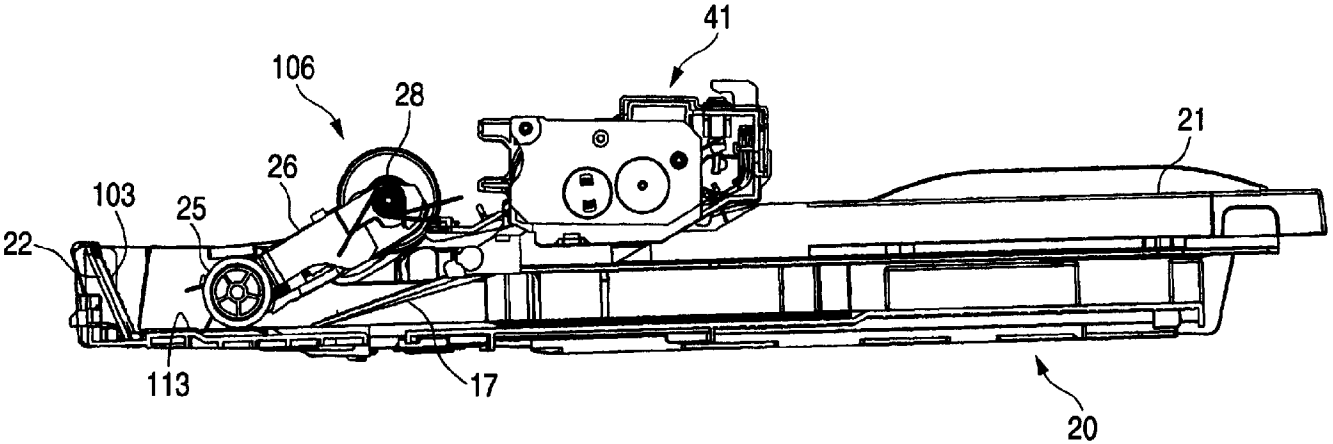
FIG. 4 is a sectional view illustrating a longitudinal sectional structure of a sheet feeding tray.
Figure 5:
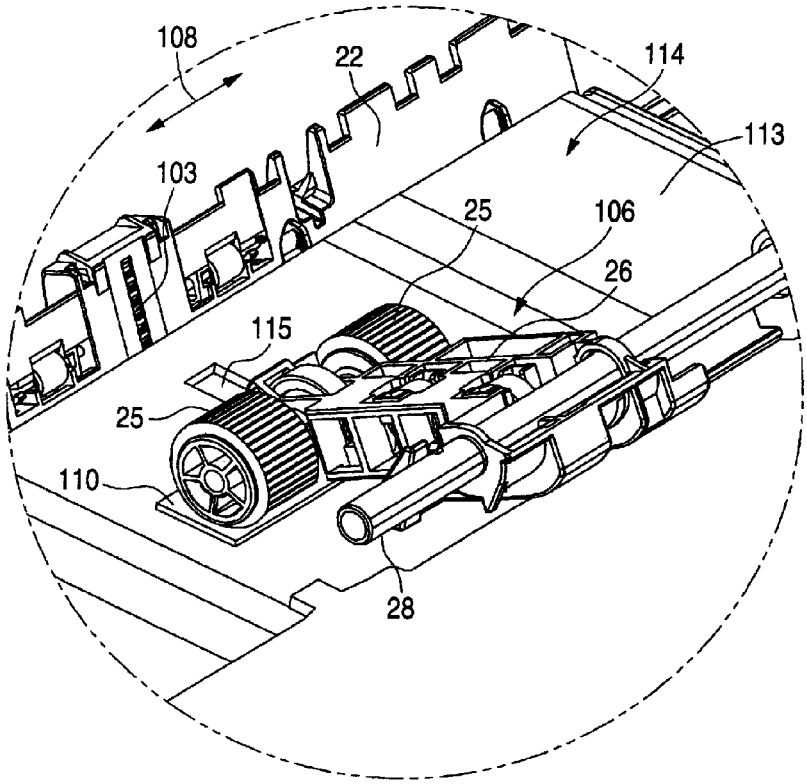
FIG. 5 is an enlarged perspective view illustrating an appearance of a feed unit.
Figure 6:
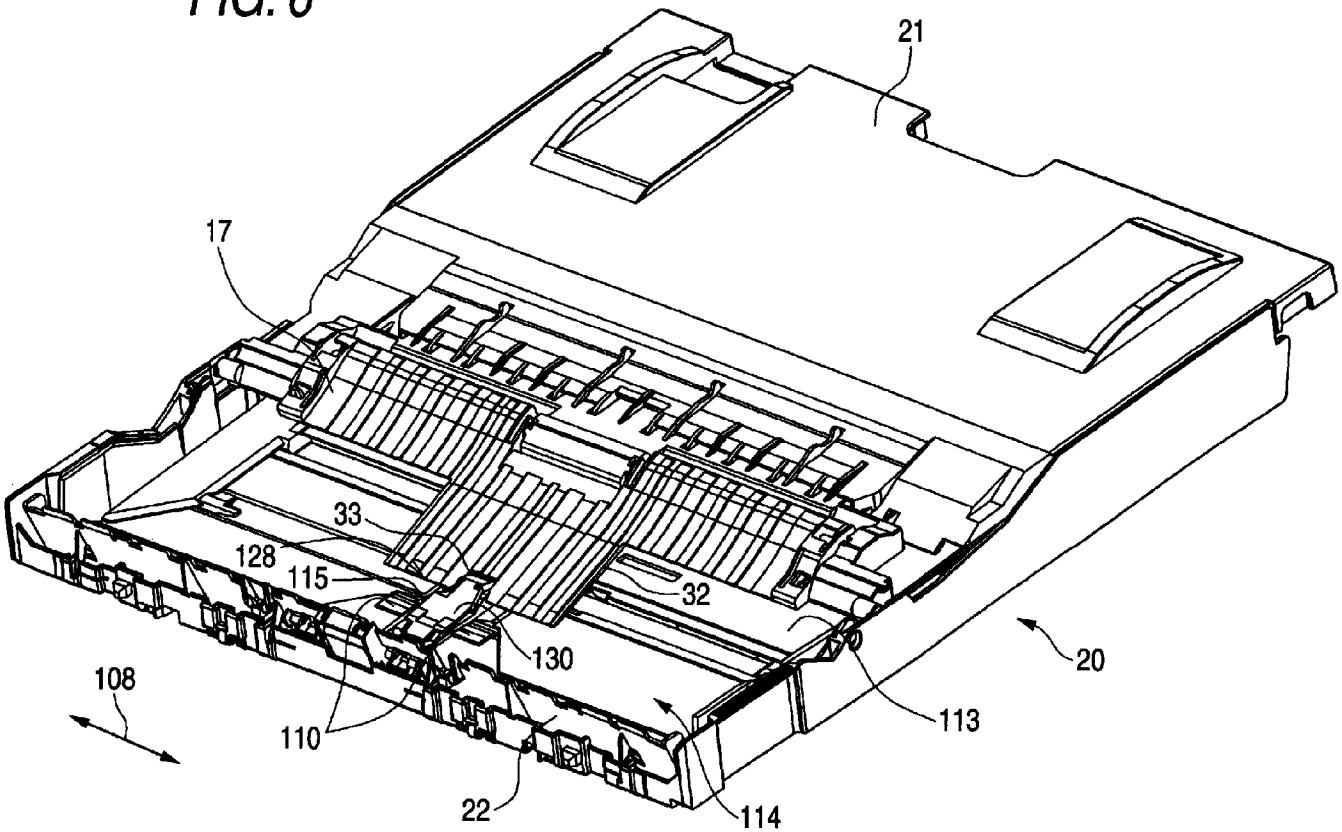
FIG. 6 is a perspective view illustrating an appearance of the sheet feeding tray.
Figure 7:
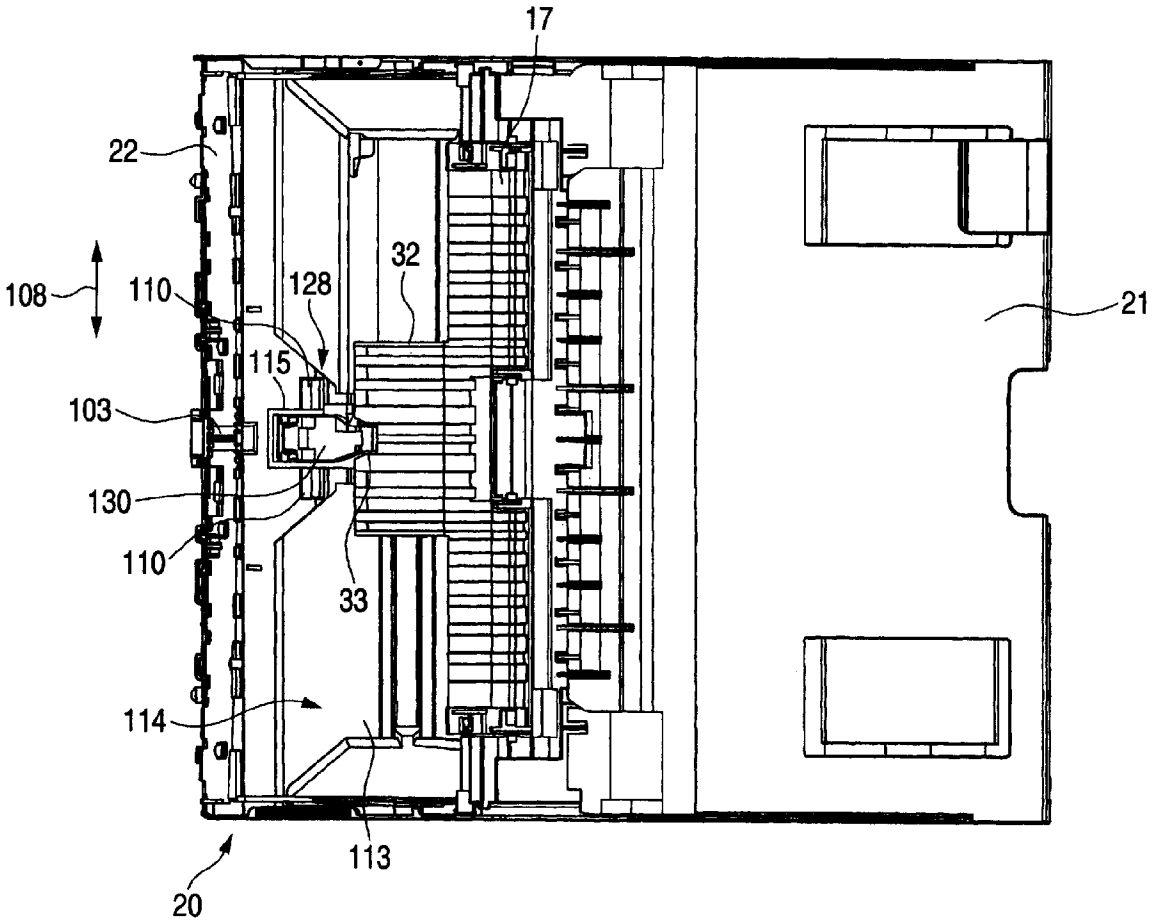
FIG. 7 is a plan view of the sheet feeding tray.
Figure 8:
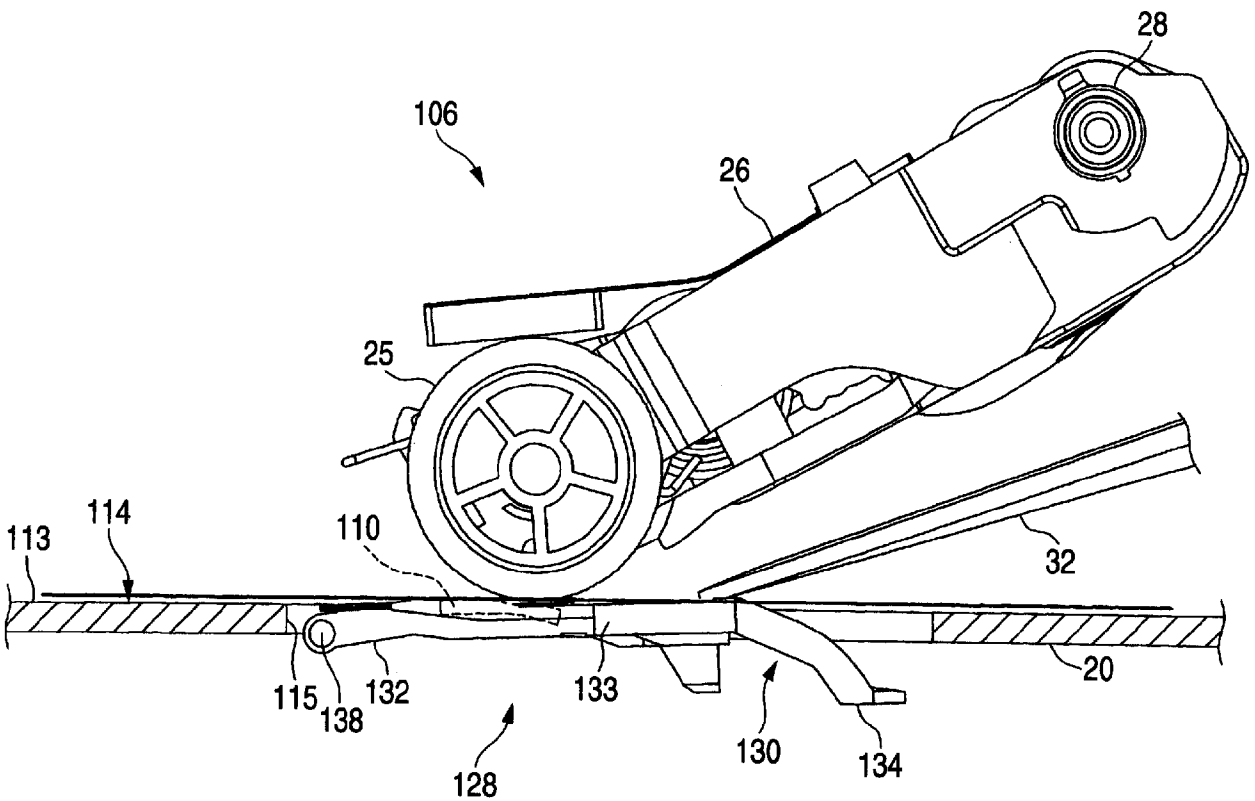
FIG. 8 is a partial side view illustrating the movement of an arm and an actuator.
Figure 9:
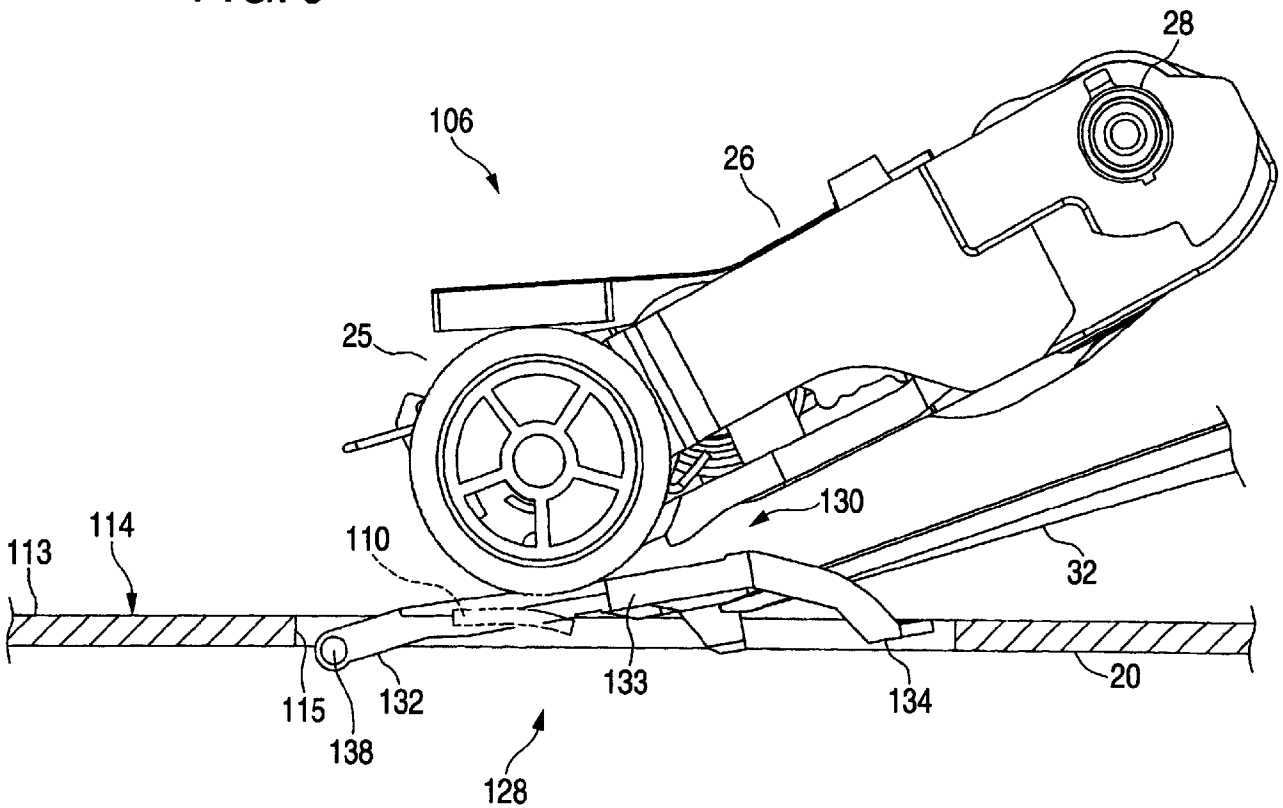
FIG. 9 is a partial side view illustrating the movement of the arm and the actuator.
Figure 10A:
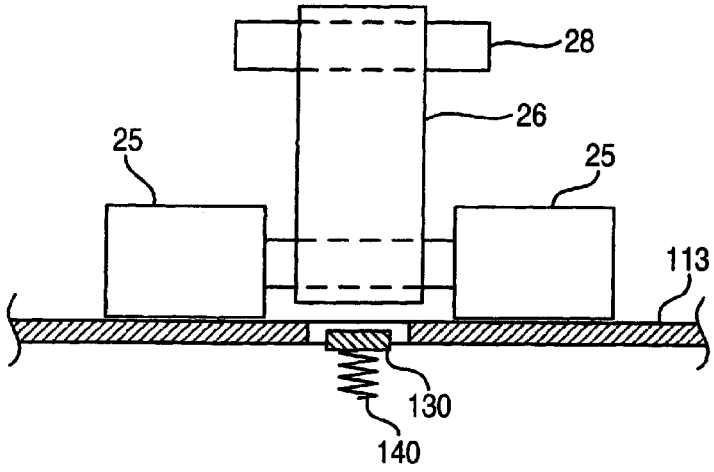
FIGS. 10A and 10B are schematic diagrams illustrating a state of the actuator as viewed from the upstream side in a sheet conveying direction.
Figure 10B:
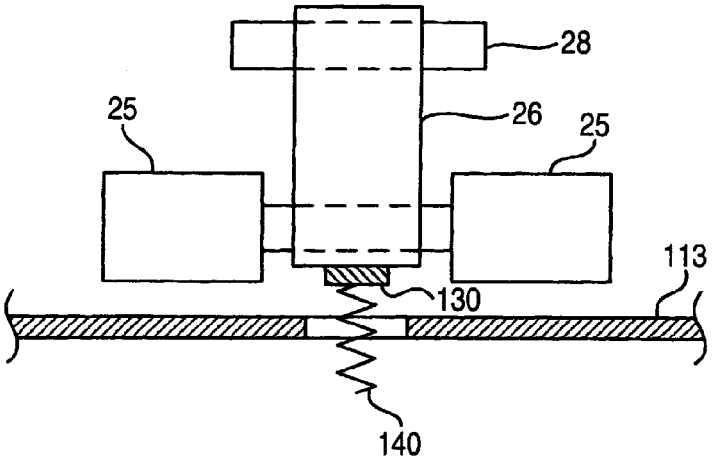

A first embodiment of the invention will be described with reference to FIGS. 1 to 10B. FIG. 1 is a perspective view illustrating an appearance of a multi function device 10 according to the first embodiment of the invention. FIGS. 2 and 3 are sectional views schematically illustrating a structure of a printer unit 11. FIG. 4 is a sectional view illustrating a longitudinal sectional structure of a sheet feeding tray 20. FIG. 5 is an enlarged perspective view illustrating an appearance of a feed unit 106. FIG. 6 is a perspective view illustrating an appearance of the sheet feeding tray 20. FIG. 7 is a plan view of the sheet feeding tray 20. FIGS. 8 and 9 are partial side views illustrating the movement of an arm 26 and an actuator 130. FIGS. 10A and 10B are schematic diagrams illustrating a state of the actuator 130 as viewed from the upstream side in a sheet conveying direction. FIGS. 8 and 10A show a retreating posture where the actuator 130 retreats into a slot 115 of a bottom plate 113. FIGS. 9 and 10B show a protruding posture where the actuator 130 protrudes from the bottom plate 113. A coil spring 140 is omitted in FIGS. 8 and 9.

A rough configuration of a multi function device 10 will be first described.

As shown in FIG. 1, the multi function device 10 (an example of the image recording device) is a multi function device (MFD) including a printer unit 11 disposed in a lower portion and a scanner unit 12 disposed in an upper portion. The multi functional device 10 has a printing function, a scanning function, a copying function, and a facsimile function. The image recording device according to the invention is not limited to the multi function device 10, but the invention may be applied to, for example, a printer not having the scanner unit 12 but having only the printing function.

The scanner unit 12 is disposed in the upper portion of the multi function device 10. The scanner unit 12 includes a flat bed scanner (FBS) and an automatic document feeder (ADF). As shown in FIG. 1, a document cover 30 is provided as a top plate of the multi function device 10 so as to be freely opened and shut. The ADF is disposed in the document cover 30. Although not shown in the drawings, a platen glass and an image sensor are disposed below the document cover 30. In the scanner unit 12, an image of a document placed on the platen glass or a document conveyed by the ADF is read out by the image sensor. The configuration of the scanner unit 12 is arbitrary and thus the detailed description thereof is omitted.

An operation panel 40 is disposed in the upper portion of the front surface of the multi function device 10. The operation panel 40 is a unit for operating the printer unit 11 or the scanner unit 12. The operation panel 40 includes a liquid crystal display for displaying a variety of information and an input key for allowing a user to input information. The multi function device 10 operates on the basis of the operation input from the operation panel 40. The multi function device 10 also operates, for example, on the basis of information transmitted from a computer connected thereto through a LAN. The multi function device 10 further includes a slot unit 43. Various compact memory cards serving as storage media can be inserted into the slot unit 43. For instance, when the user operates the operation panel 40 while a compact memory card is mounted to the slot unit 43, data (such as image data) stored in the compact memory card can be read and recorded on a recording sheet.

In the multi function device 10, the printer unit 11 is configured to record an image on a sheet on the basis of image data read out by the scanner unit 12 or image recording data transmitted to the computer connected thereto externally.

Now, the inner configuration of the multi function device 10, particularly, the printer unit 11, will be described.

As shown in FIG. 1, the printer unit 11 has an opening 13 formed in the front surface thereof. A sheet feeding tray 20 (an example of the tray) and a sheet discharging tray 21 are disposed inside the opening 13. The sheet feeding tray 20 and the sheet discharging tray 21 are provided in a two-stage structure in which the sheet discharging tray 21 is disposed above the sheet feeding tray 20.

As shown in FIGS. 6 and 7, the sheet feeding tray 20 has a substantially rectangular box shape. The sheet feeding tray 20 includes a bottom plate 113 defining a sheet placing surface. Plural sheets can be stacked on a top surface 114 (placing surface) of the bottom plate 113. The sheet feeding tray 20 is disposed close to the bottom of the printer unit 11 (see FIG. 1). The sheets stacked in the sheet feeding tray 20 are fed into the printer unit 11.

The sheet discharging tray 21 is disposed above the sheet feeding tray 20. A flap 17 is fitted to an end (left end portion in FIG. 2) of the sheet discharging tray 21. The flap 17 forms a part of a second conveying path 15 to be described later. The flap 17 is axially supported by the end of the sheet discharging tray 21 so as to be rotatable. As shown in the drawings, the flap 17 includes a protruding portion 32 protruding from the center in the width direction 108 (perpendicular to the feeding direction) of the sheet feeding tray 20. The end of the flap 17, that is, the end of the protruding portion 32, extends up to the top surface 114 of the sheet feeding tray 20. Specifically, the end of the flap 17 extends up to the vicinity of an actuator 130 (an example of the first actuation unit) to be described later.

A cut 33 is formed at the center in the width direction 108 of the end of the protruding portion 32. The cut 33 has substantially the same width as a slot 115 to be described later formed in the bottom plate 113. The actuator 130 to be described later is inserted through the cut 33. Accordingly, the actuator 130 does not contact with the protruding portion 32 of the flap 17. The flap 17 rotates in a direction (direction in which it gets close to the sheet feeding tray 20) indicated by an arrow 119 in FIG. 2 by its weight or by a twist coil spring (not shown) disposed in a rotation shaft, and the end thereof contacts with the uppermost sheet. Accordingly, a predetermined pressing force F2 (see FIG. 2) from the flap 17 acts on the sheet placed on the sheet feeding tray 20. The pressing force F2 is transmitted to the actuator 130 through the sheets. Of course, when no sheet is placed in the sheet feeding tray 20, the pressing force F2 acts on the top surface 114 of the sheet feeding tray 20.

As shown in FIG. 4, a slope plate 22 is disposed in the sheet feeding tray 20. The slope plate 22 is sloped to the rear side. The slope plate 22 is configured to separate a sheet from the sheet feeding tray 20 and to guide the sheet upward. When the uppermost sheet in the sheet feeding tray 20 is sent out to the slope plate 22 and the leading end contacts with the slope plate 22, the feeding direction (conveying direction) of the sheet is changed to the upside by the slope plate 22. Accordingly, the sheets are fed upward to the first conveying path 23 sheet by sheet.

A separating member 103 is disposed in the inside surface of the slope plate 22. The separating member 103 is disposed at the center in the longitudinal direction of the inside surface of the slope plate 22. In the separating member 103, plural teeth protruding from the inside surface are arranged in the slope direction of the slope plate 22. Even when plural sheets are overlapped and fed, the leading ends of the plural sheets coming in contact with the inside surface of the slope plate 22 are processed by the separating member 103. Accordingly, the sheets can be easily separated and only the uppermost sheet is reliably separated from the lower sheets.

As shown in FIGS. 2 and 3, the first conveying path 23 is disposed above the slope plate 22. The first conveying path 23 is a path along which a sheet is conveyed and a part thereof is curved. Specifically, the first conveying path 23 extends upward from the slope plate 22, is bent to the front side (right side in FIG. 2) of the multi function device 10, extends to the front side, extends to the sheet discharging tray 21 (see FIG. 1) through a recording unit 24 (an example of the recording unit). A sheet placed in the sheet feeding tray 20 is guided to the platen 42 along the first conveying path 23 so as to turn in a U shape from down to up, an image is recorded thereon by the recording unit 24, and then the resultant sheet is discharged to the sheet discharging tray 21 (see FIG. 1).

The first conveying path 23 is defined by an outer guide surface and an inner guide surface in the place other than the position at which the recording unit 24 and the like is disposed. For example, the curved portion of the first conveying path 23 in the rear portion of the multi function device 10 is formed by disposing the outer guide member 18 and the inner guide member 19 so as to be opposed to each other with a predetermined gap therebetween. In this case, the outer guide member 18 forms a guide surface outside the curved portion and the inner guide member 19 forms a guide surface inside the curved portion. The outer guide member 18 and the inner guide member 19 are fixed to a chassis or a frame of the multi function device 10.

A second conveying path 15 is connected to a predetermined position (hereinafter, referred to as a "downstream portion") 36 of the first conveying path 23 downstream in the conveying direction from the recording unit 24. The second conveying path 15 is formed by a guide member 16 extending obliquely downward from the downstream portion 36 to the sheet feeding tray 20 and the above-mentioned flap 17 axially supported by the sheet discharging tray 21.

As described in detail later, when the double-side recording function of recording an image on both sides is selected in the multi function device 10, the one-side recorded sheet in which an image is formed on one side thereof is conveyed in a switch-back manner by a path switching unit 41 (an example of the conveyance unit) to be described and then is conveyed to the second conveying path 15. Then, the one-side recorded sheet is guided along the second conveying path 15, is once received in the sheet feeding tray 20, and then is conveyed again to the recording unit 24 through a predetermined position (hereinafter, referred to as an "upstream portion") 37 upstream in the conveying direction from the recording unit 24. The path switching unit 41 will be described in detail later.

As shown in FIGS. 2 to 5, a feed unit 106 is disposed above the sheet feeding tray 20. The feed unit 106 includes a feed roller 25 (an example of the rotating member), an arm 26, and a base shaft 28 (an example of the shaft).

The feed roller 25 is rotatably supported by the end portion of the arm 26. By allowing the feed roller 25 to contact with a sheet on the sheet feeding tray 20 and to rotate, the sheet is fed from the sheet feeding tray 20 to the first conveying path 23. In this embodiment, as shown in FIG. 5, two feed rollers 25 are disposed at the end portion of the arm 26. Specifically, two feed rollers 25 are disposed on both sides of the arm 26, respectively, with the end portion of the arm 26 interposed therebetween. Accordingly, two feed rollers 25 are apart from each other in the width direction 108 (direction perpendicular to the feeding direction) of the sheet feeding tray 20 by the width of the arm 26.

The base shaft 28 is disposed in a frame (not shown) of the printer unit 11. As shown in FIG. 5, the base shaft 28 extends in the width direction 108 of the sheet feeding tray 20. The arm 26 is swingably supported by the base shaft 28. Accordingly, the arm 26 can rotate about the base shaft 28 in directions toward and away from the top surface 114 of the bottom plate 113 of the sheet feeding tray 20 or the top surface of the sheet placed in the sheet feeding tray 20. That is, the arm 26 can rotate in one direction of a second direction 102 (see FIGS. 2 and 3) in which the feed roller 25 moves toward the top surface 114 of the bottom plate 113 or the top surface of the sheet and a first direction 101 (see FIGS. 2 and 3) in which the feed roller 25 moves away from the top surface 114 of the bottom plate 113 or the top surface of the sheet. In this embodiment, the arm 26 can change its posture between a contact posture (see FIGS. 8 and 10A) where the roller surface of the feed roller 25 contacts with the top surface 114 of the bottom plate 113 or the sheet and a separation posture (see FIGS. 9 and 10B) where the feed roller 25 is separated from the sheet feeding tray 20.

The base shaft 28 is connected to a driving shaft of the motor. The driving power input to the base shaft 28 is transmitted to the feed roller 25 through a driving power transmitting mechanism (not shown) and including a gear and the like. That is, the feed roller 25 is rotationally driven using the motor (not shown) as a driving source. When the driving power is transmitted to the base shaft 28, a frictional force (sliding friction) is generated between the base shaft 28 and the arm 26. The arm 26 rotates in the second direction 102 (see FIGS. 2 and 3) in which the arm 26 moves toward the sheet feeding tray 20 by the frictional force. At this time, a force in the gravitational direction (in the down direction in FIG. 2) acts on the feed roller 25 by the weight of the arm 26 or the frictional force. The feed roller 25 is pressed on the sheet on the sheet feeding tray 20 with the force. In this state, when the feed roller 25 rotates clockwise in FIG. 2, a predetermined frictional force is generated between the roller surface of the feed roller 25 and the sheet and the frictional force acts as a conveying force of the sheet. By the conveying force (frictional force), the uppermost sheet is sent out to the first conveying path 23 along the arrow 14 (see FIG. 2). At this time, a lower sheet may be sent out together due to friction or static elasticity, but the lower sheet is prevented from the sending due to the contact of the leading end thereof with the slope plate 22.

A frictional pad 110 (an example of the frictional member) is fitted to the bottom plate 113 of the sheet feeding tray 20. The frictional pad 110 is disposed at the center portion in the width direction 108 of the sheet feeding tray 20. The frictional pad 110 is formed in a thin plate shape out of a material such as cork or rubber. The number of frictional pads 110 corresponds to the number of feed rollers 25. In this embodiment, as shown in FIGS. 6 and 7, two friction pads 110 corresponding to two feed rollers 25 are disposed. Similarly to the feed rollers 25, the frictional pads 110 are apart from each other in the width direction 108. When the arm 26 rotates and the feed rollers 25 thus move in the second direction 102, the feed rollers 25 are disposed just above or substantially just above the corresponding frictional pads 110. The frictional pads 110 have a substantially rectangular shape having long sides extending along the axis direction of the feed rollers 25. The length in the long sides of the frictional pads 110 is equal to or greater than the length in the axis direction of the feed rollers 25. When only one feed roller 25 is provided, the frictional pad 104 has a length corresponding to a length of one feed roller 25.

As shown in FIGS. 6 and 7, a slot 115 extending in the sheet feeding direction is formed in the bottom plate 113. The slot 115 is formed just below the lower end of the arm 26 and substantially between two frictional pads 110 disposed at the center in the width direction 108 of the bottom plate 113. The slot 115 penetrates the bottom plate 13 from the surface to the rear surface. A moving mechanism 128 to be described later is disposed in a place from the slot 115 to the rear surface of the bottom plate 113. The slot 115 is provided to allow the actuator 130 of the moving mechanism 128 to protrude and retreat from the top surface 114 of the bottom plate 113. The moving mechanism 128 will be described in detail later.

As shown in FIGS. 2 and 3, the recording unit 24 is disposed in the middle way of the first conveying path 23. The recording unit 24 is configured to record an image on the sheet in conveyance. The recording unit 24 includes a carriage 38 and an ink jet recording head 39. The ink jet recording head 39 is mounted on the carriage 38. The carriage 38 can reciprocate in a main scanning direction (the direction perpendicular to the paper surface of FIG. 2). The ink jet recording head 39 is supplied with ink from the above-mentioned ink cartridge through an ink tube. The ink is ejected as minute ink droplets from the ink jet recording head 39 while the carriage 38 reciprocates. Accordingly, an image is recorded on the sheet conveyed over the platen 42. The recording system of the recording unit 24 is not limited to the ink jet recording system, but may be other systems such as an electrophotographic system.

As shown in FIGS. 2 and 3, a conveying roller 60 and a pinch roller 61 are disposed upstream in the sheet conveying direction from the recording unit 24 in the first conveying path 23. A discharge roller 62 and a spur 63 are disposed downstream in the sheet conveying direction from the recording unit 24 in the first conveying path 23. The conveying roller 60 and the pinch roller 61 send the sheet onto the platen 42 by rotating with the sheet nipped therebetween. The discharge roller 62 and the spur 63 convey the sheet to the downstream portion 36 by rotating with the nipped sheet having passed through the platen 42. The conveying roller 60 and the discharge roller 62 are synchronously driven using the motor as a driving source.

As shown in FIGS. 2 and 3, the path switching unit 41 is disposed downstream from the recording unit 24 in the first conveying path 23. Specifically, the path switching unit 41 is disposed in the downstream portion 36 which is a connection portion between the first conveying path 23 and the second conveying path 15. The path switching unit 41 includes a roller pair of a roller 45 and a roller 46 and an assistant roller 47 disposed parallel to the roller 46. The roller 46 and the assistant roller 47 are fitted to the frame 48. The frame 48 extends in the width direction (direction perpendicular to the paper surface of FIG. 2) of the multi function device 10.

In the frame 48, plural rollers 46 and plural assistant rollers 47 are arranged with a predetermined gap in the width direction of the multi function device 10. The rollers 46 and the assistant rollers 47 are supported by shafts 50 and 51 of which the axis direction is perpendicular to the paper surface of FIG. 2, and are rotatably supported by the shafts 50 and 51. The rollers 46 and the assistant rollers 47 contact with the recording surface of the sheet, and thus have a spur shape, similarly to the spur 63. The assistant rollers 47 are disposed upstream in the first conveying path 23 by a predetermined distance from the rollers 46. The rollers 46 are urged to the rollers 45 by an elastic member.

The roller 45 rotates forward or backward using the motor as a driving source. Although not shown in the figure, the roller 45 is connected to the motor through a predetermined driving power transmitting mechanism. The roller 45 has a center shaft 52. The driving power transmitting mechanism is connected to the center shaft 52 and the guide member 16 is loosely inserted thereto. A bracket may be disposed in the center shaft 52. For example, by screwing the bracket to the body frame, the center shaft 52 is reliably supported by the frame.

The rollers 46 are placed above the roller 45. The roller 45 may have a single thin and longitudinal cylinder shape or may have plural rollers opposed to the rollers 46. The roller 45 is made to rotate forward and backward by the motor. The sheet conveyed along the first conveying path 23 is nipped between the roller 45 and the rollers 46.

In the path switching unit 41, the frame 48, the rollers 46, and the assistant rollers 47 monolithically rotate about the center shaft 52 in the direction of the arrow 29. The path switching unit 41 changes its posture in the direction of the arrow 29 depending on the driving power transmitted from the motor. Specifically, the path switching unit 41 can change its posture to a discharge posture (see FIG. 2) where the sheet having passed through the recording unit 24 is discharged to the sheet discharging tray 21 and an inversion posture (see FIG. 3) where the sheet having passed through the recording unit 24 is guided to the second conveying path 15 and is inverted.

When the roller 45 is made to rotate forward (clockwise in FIGS. 2 and 3) by the motor, the path switching unit 41 holds the discharge posture. Accordingly, the sheet having passed through the recording unit 24 is sent to the sheet discharging tray 21 (to the right in FIG. 2). When the one-side recording operation is performed, the roller 45 is made to continuously rotate forward and thus the sheet is nipped between the roller 45 and the rollers 46, is conveyed downstream, and is discharged to the sheet discharging tray 21, as shown in FIG. 2.

When the double-side recording operation is performed, the path switching unit 41 changes its posture from the discharge posture to the inversion posture in a state where the roller 45 and the rollers 46 nip a part of the sheet which is in the vicinity of the trailing end of the sheet. This change in posture is performed by changing the rotation direction of the motor to change the rotation direction of the roller 45 from the forward rotation to the backward rotation (counterclockwise rotation in FIGS. 2 and 3). By allowing the path switching unit 41 to change its posture to the inversion posture, the trailing end of the sheet is pressed downward by the assistant rollers 47. Accordingly, the one-side recorded sheet having passed through the recording unit 24 is conveyed in the switch-back manner and is sent from the trailing end side to the second conveying path 15.

In this embodiment, the driving power of the motor is transmitted to the feed roller 25 through the base shaft 28 when the roller 45 rotates forward, and the driving power is not transmitted to the feed roller 25 when the roller 45 rotates backward. That is, while the sheet is being conveyed along the second conveying path 15 by the roller 45, the driving power is not transmitted to the base shaft 28. This configuration can be embodied by a transmission switching mechanism such as a clutch or a planet gear. Of course, the feed roller 25 may be controlled by a motor independent of the other driving power transmitting system.

The bottom plate 113 is provided with the moving mechanism 128. The moving mechanism 128 allows the feed roller 25 to move relative to the sheet feeding tray 20. Specifically, the moving mechanism 128 allows the feed roller 25 to move in the first direction 101 (see FIG. 3) before the leading end of the one-side recorded sheet reaches the frictional pad 110 in the course of conveying the one-side recorded sheet to the second conveying path 15 by the use of the roller 45 and the rollers 46 of the path switching unit 41 in a state where no sheet is placed on the sheet feeding tray 20. The moving mechanism 128 allows the feed roller 25 to move in the second direction 102 (see FIG. 3) after the leading end of the sheet reaches the frictional pad in a state where no sheet is placed on the sheet feeding tray 20. In this embodiment, the moving mechanism 128 includes an actuator 130, a shaft 138, and a coil spring 140 (an example of the elastic member).

As shown in FIG. 3, the shaft 138 is provided at the bottom plate 113. The shaft 138 extends in the width direction 108 (see the drawing) of the sheet feeding tray 20, that is, in the direction perpendicular to the paper surface of FIG. 3. Although not shown in detail in FIG. 3, the shaft 138 is provided, for example, at a reinforcing rib formed on the rear surface of the bottom plate 113. The shaft 138 crosses the slot 115 formed in the bottom plate 113 in plan view. The center of the shaft 138 is an example of the predetermined point.

As shown in FIGS. 3 and 8, the actuator 130 has an arch shape in a sectional view. The actuator 130 includes a bearing portion 132 (base end) axially rotatably supported by the shaft 138, a body portion 133 extending from the bearing portion 132, and a free end 134 as the extending end (distal end).

A shaft hole is formed in the bearing portion 132. The shaft 138 is inserted through the shaft hole. Accordingly, the actuator 130 can rotate using the shaft 138 as a shaft core.

The actuator 130 is disposed in the slot 115. The actuator 130 has a size corresponding to the slot 115 so as to protrude and retreat from the top surface 114 on the rear surface side of the bottom plate 113 through the slot 115. Accordingly, the actuator 130 can change its posture to a second posture where it retreats from the top surface 114 of the bottom plate 113 as shown in FIGS. 8 and 10A and a first posture where it protrudes from the top surface 114 of the bottom plate 113 as shown in FIGS. 9 and 10B. In the state where no sheet is placed on the sheet feeding tray 20, the actuator 130 moves to the top surface 114 and the body portion 133 contacts with the lower end of the arm 26 just above the slot 115.

The body portion 134 has substantially a straight shape. In the state where the actuator 130 is held in the second posture (see FIGS. 8 and 10A), the upper end of the body portion 133 is substantially flush with the top surface 114 of the bottom plate 113. As shown in FIG. 3, the coil spring 140 is disposed below the body portion 133. The upper end of the coil spring 140 is connected to the lower end of the body portion 134, and the lower end thereof is secured to a supporting portion 141 provided at the bottom plate 113. The coil spring 140 is a so-called compression spring and always urges upward the body portion 133. That is, the coil spring 140 urges the body portion in the direction in which the actuator 130 rotates upward (in the direction of the first posture). Accordingly, in the state where no sheet is placed on the sheet feeding tray 20, the actuator 130 contacts with the lower end of the arm 26 to press the arm 26 in the first direction 101. Although the coil spring 140 has been exemplified as the elastic member in this embodiment, a twist spring disposed in the shaft 138 may be used. Instead of the coil spring 140, a variety of elastic member such as a leaf spring or an elastic rubber member can be used.

In this embodiment, by the frictional force generated between the base shaft 28 and the arm 26 when the driving power from the motor is transmitted to the base shaft 28 or the weight of the arm 26 and the feed roller 25, a pressing force F1 (see FIG. 2) for pressing the top surface 114 of the sheet feeding tray 20 downward acts. As described above, a pressing force F2 (see FIG. 2) for pressing the top surface 114 of the sheet feeding tray 20 also acts by the weight of the flap 17 and the like. In this embodiment, the spring force (urging force) F3 (see FIG. 2) of the coil spring 140 pressing up the actuator 130 is smaller than the resultant force of the pressing forces F1 and F2 (F3<F1+F2) and is greater than the pressing force F1 (F3>F1). The pressing force F1 is an example of the first force, and the resultant force of the pressing force F1 and the pressing force F2 is an example of the second force.

When the feed roller 25 rotates to feed the sheet placed on the sheet feeding tray 20, the pressing force F1 is applied to the actuator 130 from the feed roller 25 through the sheet due to the coil spring 140 having the spring force. The pressing force F2 is applied to the actuator 130 from the flap 17 through the sheet. Of course, the weight of the sheet is also applied to the actuator 130. At this time, since the pressing forces F1, F2, and F3 satisfy the relation "F3<F1+F2", the actuator 130 is changed to the second posture (retreating posture) where the actuator 130 retreats from the top surface 114 of the bottom plate 113 against the coil spring 140 (see FIGS. 8 and FIG. 10A).

On the other hand, when no sheet is placed on the sheet feeding tray 20, only the pressing force F1 is applied to the actuator 130. At this time, since the pressing forces F1 and F3 satisfy the relation of "F3>F1", the actuator 130 rotates in the first direction by the spring force F3. Accordingly, the actuator 130 is changed to the first posture (protruding posture) where the actuator 130 protrudes from the bottom plate 113 (see FIGS. 9 and 10B). At this time, the actuator 130 contacts with the lower end of the arm 26 to push up the arm 26 in the first direction. Accordingly, the feed roller 25 is pushed up in the first direction along with the arm 26 and thus gets apart from the top surface 114 and the frictional pad 110.

Since the moving mechanism 128 is disposed in the printer unit 11, the printer unit 11 operates as follows at the time of performing the double-side recording operation on the final sheet remaining on the sheet feeding tray 20.

For example, when a print start command is given by a predetermined operation from the operation penal 40, the driving power is transmitted to the base shaft 28 from the motor. At this time, the feed roller 25 and the flap 17 are in contact with the sheet on the sheet feeding tray 20 and the actuator 130 retreats into the slot 115 (see FIGS. 8 and 10A). When the driving power is transmitted from the base shaft 28 to allow the arm 26 to rotate in the second direction 102 and to allow the feed roller 25 to rotate, the final sheet on the sheet feeding tray 20 is fed to the first conveying path 23.

The sheet fed from the sheet feeding tray 20 to the first conveying path 23 is conveyed along the first conveying path 23 by the conveying roller 60, the pinch roller 61, the discharge roller 62, and the spur 63. In the conveying course, an image is recorded on one side of the sheet by the recording unit 24.

The one-side recorded sheet on one side of which the image has been recorded by the recording unit 24 is conveyed to the sheet discharging tray 21 by the roller 45 and the rollers 46 rotating forward. At this time, the path switching unit 41 holds the discharge posture (see FIG. 2). When the trailing end of the one-side recorded sheet reaches a predetermined position upstream from the assistant rollers 47, the rotation direction of the motor is changed and the path switching unit 41 is changed from the discharge posture to the inversion posture (see FIG. 3). The trailing end of the one-side recorded sheet is pressed down by the assistant rollers 47 and the sheet travels to the second conveying path 15.

When the rotation direction of the motor is changed, the roller 45 and the rollers 46 are changed from the forward rotation to the backward rotation. Accordingly, the one-side recorded sheet is changed in the conveying direction and is conveyed in the switch-back manner to the second conveying path 15. As a result, the one-side recorded sheet is returned to the sheet feeding tray 20. At this time, the driving power to the base shaft 28 is stopped. In this state, since the sheet feeding tray 20 is empty, the pressing force F2 from the flap 17 is not applied to the actuator 130. Accordingly, the actuator 130 protrudes from the slot 115 to the top surface 114 of the bottom plate 113 and contacts with the lower end of the arm 26, thereby pushing up the arm 26 (see FIGS. 9 and 10B). As a result, the feed roller 25 moves away from the frictional pad 110. In this state, when the one-side recorded sheet conveyed in the second conveying path 15 is guided to the sheet feeding tray 20, the leading end of the one-side recorded sheet is guided to the actuator 130 and enters the downstream side in the conveying direction from the feed roller 25. At this time, since the leading end of the one-side recorded sheet does not contact with the frictional pad 110, the one-side recorded sheet travels downstream in the conveying direction from the feed roller 25 without any resistance of the frictional pad 110.

Since the frictional force at the contact point between the actuator 130 and the arm 26 acts opposite to the conveying direction of the one-side recorded sheet but the frictional force is small, The frictional force does not influence the conveyance of the one-side recorded sheet.

When the one-side recorded sheet is returned to the sheet feeding tray 20 and the one-side recorded sheet enters between the actuator 130 and the feed roller 25, the weight of the one-side recorded sheet and the pressing force at the time of entrance in addition to the pressing force F1 act in the direction in which the actuator 130 moves down. Accordingly, the actuator 130 is pressed downward and retreats into the slot 115 of the bottom plate 113.

When the one-side recorded sheet is returned to the sheet feeding tray 20, the rotation direction of the motor is changed and the roller 45 and the rollers 46 are changed from the backward rotation to the forward rotation. At the same time, the path switching unit 41 is changed from the inversion posture to the discharge posture. The driving power of the motor is transmitted to the base shaft 28 and the feed roller 25 rotates again. At this time, the pressing force from the rotating arm 26 in the second direction 102 is further applied to the actuator 130. Accordingly, the actuator 130 is made to reliably retreat into the slot 115.

The rotating feed roller 25 nips the leading end of the one-side recorded sheet to feed the one-side recorded sheet to the first conveying path 23. Accordingly, the one-side recorded sheet is inverted up and down. That is, when the one-side recorded sheet is conveyed onto the platen 42, the side on which an image is not recorded faces the ink jet recording head 39. Thereafter, an image is recorded on the other side of the one-side recorded sheet when it passes through the platen 42. The double-side recorded sheet on both sides of which images have been recorded is discharged from the first conveying path 23 to the sheet discharging tray 21 by the path switching unit 41.

In the printer unit 11, when the double-side recording operation is performed on the final sheet placed on the sheet feeding tray 20, the feed roller 25 is separated from the frictional pad 110 while the sheet is being conveyed to the second conveying path 15. Accordingly, the leading end of the one-side recorded sheet can smoothly travel downstream in the conveying direction from the feed roller 25 without any resistance. After the leading end of the one-side recorded sheet reaches the downstream side of the feed roller 25, the feed roller 25 is pressed on the one-side recorded sheet, thereby reliably nipping the one-side recorded sheet between the feed roller 25 and the frictional pad 110. Accordingly, it is possible to reliably convey the one-side recorded sheet by the use of the feed roller 25.

Second Embodiment

Figure 11A:
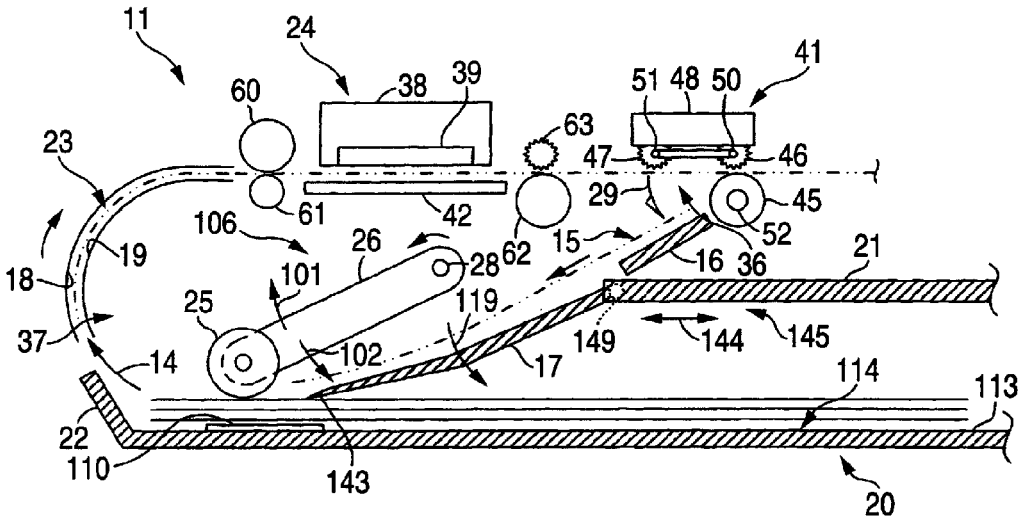
FIGS. 11A and 11B are schematic sectional views illustrating a structure of a printer according to a second embodiment of the invention.
Figure 11B:
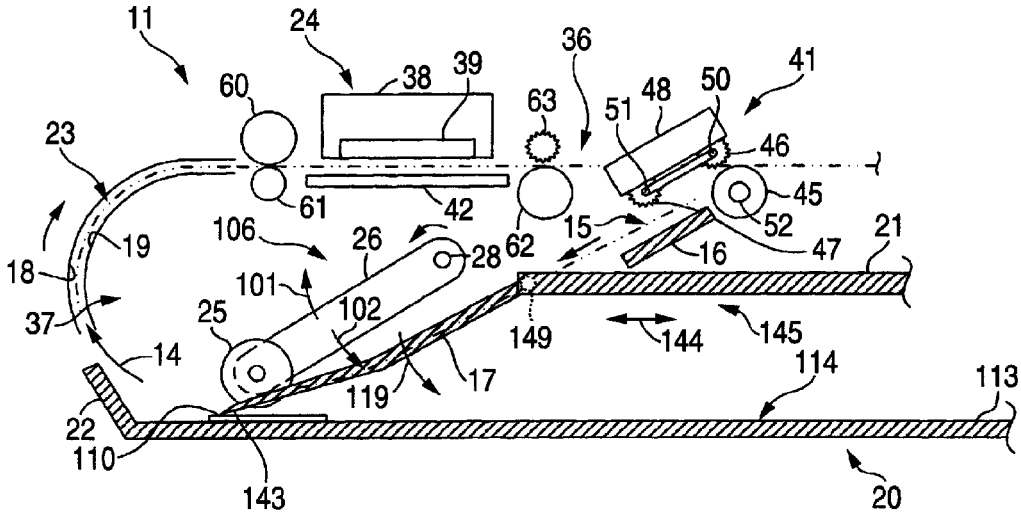

A second embodiment of the invention will be described now with reference to FIGS. 11A and 11B. FIGS. 11A and 11B are schematic diagrams illustrating a structure of a printer unit 11 according to the second embodiment of the invention. The multi function device 10 according to the second embodiment is different from the first embodiment, in that a moving mechanism 145 is provided instead of the moving mechanism 128 and the slot 115 is not formed in the bottom plate 113. The other elements of the second embodiment are the same as the above-mentioned embodiment. Accordingly, the same elements are denoted by the same reference numerals in FIGS. 11A and 11B and description thereof is omitted.

In this embodiment, the moving mechanism 145 is disposed below the path switching mechanism 41. The moving mechanism 145 includes a sheet discharging tray 21, a flap 17, a shaft 149, and an interworking mechanism (not shown). In this embodiment, the sheet discharging tray 21 and the flap 17 are an example of the second actuation unit.

The sheet discharging tray 21 is slidably supported by the sheet feeding tray 20. Specifically, the sheet discharging tray can slide in the same direction (direction indicated by the arrow 144) as the sheet conveying direction. The sheet discharging tray 21 may be slidably fitted to the chassis or the inner frame of the printer unit 11. The sheet discharging tray 21 slides in the direction of the arrow 144 by interworking with the path switching mechanism 41. Specifically, in the state where the path switching mechanism 41 holds the discharge posture, the sheet discharging tray 21 holds the second posture where it is disposed in the right side of FIGS. 11A and 11B (see FIG. 11A). When the path switching mechanism 41 is changed from the discharge posture to the inversion posture, the sheet discharging tray 21 is changed from the second posture to the first posture where it is disposed in the left side of FIGS. 11A and 11B by interworking therewith (see FIG. 11B). The interworking mechanism allowing the path switching mechanism 41 and the sheet discharging tray 21 to interwork with each other can be embodied by a link member or gear.

The shaft 149 is disposed at one end of the sheet discharging tray 21 (in FIGS. 11A and 11B, the left end of the sheet discharging tray 21). The flap 17 is loosely locked to the shaft 149. The flap 17 is rotatable in the direction indicated by the arrow 119 in FIGS. 11A and 11B by its weight or a twist coil spring (not shown), and the other end thereof contacts with the top surface of the bottom plate 113 of the sheet feeding tray 20 or the uppermost sheet. The end of the flap 17 extends to the position where the frictional pad 110 is disposed, unlike the first embodiment. An end 143 of the flap 17 has a shape such that when the sheet discharging tray 21 is in the first posture, the end 143 contacts with the lower end of the arm 26 but does not contact with the feed roller 25. For example, a cutout or a slit is formed at a position corresponding to the feed roller 25 at the end 143 of the flap 17.

In this embodiment, when the sheet discharging tray 21 holds the second posture, the end 143 of the flap 17 is located at a position apart from the frictional pad 110 and the feed roller 25 (see FIG. 11A). On the other hand, when the flap 17 holds the first posture, the flap 17 moves to the left in FIGS. 11A and 11B and the end 143 thereof enters between the lower end of the arm 26 and the frictional pad 110 (see FIG. 11B). Accordingly, the arm 26 is lifted up from the lower end.

Since the moving mechanism 145 is disposed in the printer unit 11, the printer unit 11 operates as follows at the time of performing the double-side recording operation on the final sheet remaining on the sheet feeding tray 20.

As described in the first embodiment, when the trailing end of the one-side recorded sheet reaches a predetermined position upstream from the assistant roller 47 at the time of performing the double-side recording operation, the rotation direction of the motor is changed and the path switching unit 41 is changed from the discharge posture to the inversion posture (see FIG. 3). In this embodiment, the sheet discharging tray 21 is changed from the second posture (FIG. 11A) to the first posture (FIG. 11B) by interworking with the change in posture of the path switching unit 41. At this time, the end 143 of the flap 17 lifts up the arm 26 from the lower end of the arm 26. Accordingly, the feed roller 25 is separated from the frictional pad 110. In this state, when the one-side recorded sheet conveyed along the second conveying path 15 is guided to the sheet feeding tray 20, the leading end of the one-side recorded sheet is guided by the flap 17 and enters the downstream side in the conveying direction from the feed roller 25. At this time, since the leading end of the one-side recorded sheet does not contact with the frictional pad 110, the leading end of the one-side recorded sheet smoothly travels downstream in the conveying direction from the feed roller 25 without any resistance of the frictional pad 110.

When the one-side recorded sheet is returned to the sheet feeding tray 20, the rotation direction of the motor is changed and the roller 45 and the rollers 46 are changed from the backward rotation to the forward rotation. At the same time, the path switching unit 41 is changed from the inversion posture to the discharge posture. The sheet discharging tray 21 is changed from the first posture (FIG. 11B) to the second posture (FIG. 11A) by interworking with the change in posture of the path switching unit 41. The driving power is transmitted to the base shaft 28 and the feed roller 25 thus rotates. Then, the rotating feed roller 25 nips the leading end of the one-side recorded sheet and feeds the one-side recorded sheet to the first conveying path 23. Accordingly, the one-side recorded sheet is inverted from up to down. Thereafter, an image is recorded on the other side of the one-side recorded sheet when the sheet passes through the platen 42. Then, the resultant sheet (double-side recorded sheet) on both sides of which the images have been recorded is discharged from the first conveying path 23 to the sheet discharging tray 21 by the path switching unit 41.

In this way, when the one-side recorded sheet is returned to the sheet feeding tray 20, the leading end of the one-side recorded sheet can be made to smoothly enter the downstream side in the conveying direction of the feed roller 25 without any resistance by the moving mechanism 145. Accordingly, the one-side recorded sheet can be reliably conveyed by the subsequent sheet feeding operation of the feed roller 25.

According to the embodiments of the invention, the following aspects are provided.

(1) An image recording device includes a tray, a feed unit, a frictional member, a recording unit, a conveyance unit, and a moving mechanism. A sheet is stacked on a placing surface of the tray. The feed unit is configured to feed the sheet on the tray and has a rotating member. The rotating member gets close to and apart from the sheet on the tray. A frictional member is disposed on the placing surface. The frictional member is located at a position on the placing surface corresponding to the rotating member. The recording unit is configured to record an image on the sheet sent from tray by the rotating member. The sheet in which an image is recorded on one side thereof by the recording unit is switched back downstream from the recording unit by the conveyance unit and is returned to the placing surface of the tray. The moving mechanism allows the rotating member to move in one of a first direction in which it gets apart from the tray and a second direction in which it gets close to the tray. In the image recording device, the moving mechanism allows the rotating member to move in the first direction before the leading end of the sheet returned by the conveyance unit reaches the frictional member in the state where no sheet is placed on the tray.

When plural sheets are placed on the tray, the rotating member contacts with the uppermost sheet. With the rotation of the rotating member, the sheets are separated sheet by sheet and are conveyed to the recording unit from the tray. At this time, the frictional force generated between the frictional member and the lowermost sheet acts on the sheet and the separation of the sheets by the rotating member are promoted. When a double-side recording operation is performed, the one-side recorded sheet is returned to the placing surface of the tray by the conveyance unit. At this time, before the leading end of the one-side recorded sheet returned to the placing surface reaches the frictional member, the rotating member moves in the first direction by the moving mechanism. Accordingly, it is possible to allow the leading end of the one-side recorded sheet to smoothly enter between the rotating member and the frictional member without any resistance.

(2) The moving mechanism may allow the rotating member, which has moved in the first direction, to move in the second direction after the leading end of the sheet reaches the frictional member. Accordingly, after the leading end of the one-side recorded sheet enters between the rotating member and the frictional member, the rotating member moves in the second direction and the sheet is reliably nipped between the frictional member and the rotating member. As a result, it is possible to reliably convey the sheet by the use of the rotating member.

(3) The feed unit may include: a shaft connected to a driving source; and an arm supported to freely swing by the shaft and rotatably supporting the rotating member at the end thereof.

(4) The moving mechanism may include: a first actuation unit that is supported to be rotatable about a predetermined point in the tray and is configured to move between a first posture where the first actuation unit protrudes from the placing surface and a second posture where the first actuation unit retreats from the placing surface; and an elastic member configured to urge the first actuation unit to the first posture. In this case, the first actuation unit contacts with the arm to push up the arm and guides the leading end of the sheet returned to the tray to the downstream in a conveying direction in the first posture. Accordingly, a mechanism for allowing the rotating member to easily move is embodied.

(5) The first actuation unit may have an arch shape extending from the predetermined point and an extending end thereof retreats from the placing surface of the tray in any of the first posture and the second posture. Accordingly, it is possible to smoothly guide the sheet by the use of the first actuation unit.

(6) The image recording device may further include a guide member supported to be rotatable in the direction in which it gets close to and apart from the placing surface and guiding the sheet returned to the tray by the conveying unit to the placing surface. In this case, the elastic member may have an elastic force greater than a first force with which the rotating member presses the tray and smaller than a second force obtained by adding the first force to a pressing force acting on the tray when the guide member contacts with the placing surface. Accordingly, it is possible to concretely embody the moving mechanism.

(7) The conveying unit may include a path switching mechanism configured to switch a sheet conveying path at the downstream of the recording unit in the conveying direction to one of a first conveying path reaching a discharging unit configured to discharge a sheet and a second conveying path for guiding a sheet to the tray. The moving mechanism may interwork with the switching operation of the path switching mechanism, gets apart from the arm when the sheet conveying path is switched to the first conveying path, and contacts with the lower end of the arm to push up the arm when the sheet conveying path is switched to the second conveying path. Accordingly, it is also possible to concretely embody the moving mechanism in the first direction and the second direction.

According to the embodiments of the invention, it is possible to reliably convey a sheet.

What is claimed is:

1. An image recording device comprising:

a tray having a placing surface on which a sheet is allowed to be placed;

a feed unit comprising a rotating member that is rotatable and configured to move in a first direction away from the placing surface of the tray and move in a second direction toward the placing surface of the tray;

a frictional member disposed on the placing surface and located at a position corresponding to the rotating member;

a recording unit configured to record an image on the sheet conveyed from the tray by the rotating member;

a conveying unit configured to return the sheet, on one side of which the image has been recorded by the recording unit, to the placing surface of the tray from a downstream side of the recording unit; and a moving mechanism configured to move the rotating member in the first direction, wherein the moving mechanism is configured to move the rotating member in the first direction before a leading end of the sheet returned by the conveying unit reaches the frictional member in a state where no sheet is placed on the tray, and wherein the moving mechanism is opposed to the rotating member and the frictional member is disposed between the moving mechanism and the rotating member before the moving mechanism moves the rotating member in the first direction.

2. The image recording device according to claim 1, wherein the rotating member, which has been moved in the first direction by the moving mechanism, moves in the second direction after the leading end of the sheet reaches the frictional member.

3. The image recording device according to claim 1, wherein the feed unit comprises:

a shaft connected to a driving source; and an arm that is swingably supported by the shaft and rotatably supports the rotating member at an end portion of the arm.

4. The image recording device according to claim 3, wherein the moving mechanism comprises:

a first actuation unit that is supported to be rotatable about a predetermined point of the tray and is moveable between a first posture where the first actuation unit protrudes from the placing surface and a second posture where the first actuation unit retreats from the placing surface; and an elastic member that urges the first actuation unit to the first posture, wherein the first actuation unit in the first posture contacts with the arm to push up the arm and guides a leading end of the sheet, which is returned to the tray, toward a downstream in a conveying direction.

5. The image recording device according to claim 4, wherein the first actuation unit includes a base end and a distal end and has an arch shape extending from the base end at the predetermined point to the distal end, and the distal end retreats from the placing surface of the tray in both the first posture and the second posture.

6. The image recording device according to claim 4, further comprising a guide member supported to be rotatable in directions toward and away from the placing surface, and the guide member being configured to guide the sheet returned to the tray by the conveying unit to the placing surface, wherein the elastic member has an elastic force greater than a first force with which the rotating member presses the tray when the moving mechanism moves the rotating member in the first direction and less than or equal to a second force obtained by adding the first force to a pressing force acting on the tray when the guide member contacts with the placing surface.

7. The image recording device according to claim 4, wherein the placing surface has a slot formed at a position facing to the end portion of the arm of the feed unit in a state where no sheet is placed on the tray, wherein the first actuation unit is capable of change the postures through the slot.

8. The image recording device according to claim 1, wherein the moving mechanism is movable between a first posture and a second posture, the moving mechanism in the first posture contacting with the feed unit such that the feed unit moves in the first direction, and the moving mechanism in the second posture being separated from the feed unit such that the feed unit moves in the second direction.

9. The image recording device according to claim 8, wherein a force is applied to the feed unit to be urged in the second direction.

10. The image recording device according to claim 9, wherein the force includes a gravitational force acting on the feed unit.

11. The image recording device according to claim 1, wherein the conveying unit comprises a path switching mechanism configured to switch a sheet conveying path at the downstream side of the recording unit in a conveying direction to one of a first conveying path connected to a discharging unit to which a sheet is discharged and a second conveying path for guiding a sheet to the tray, wherein the path switching mechanism comprising a roller configured to rotate in a first rotation direction to convey the sheet in the first conveying path and in a second rotation direction to convey the sheet in the second conveying path, wherein, while the roller of the path switching mechanism rotates in the second rotation direction, the rotating member is driven to stop rotating.

* * * * *